United States Patent [19]

Drescher

[11] 4,067,081

[45] * Jan. 10, 1978

[54] SWIMMER'S GLOVE

[76] Inventor: Gary Clyde Drescher, 1000 Lindbergh Ave., Stroudsburg, Pa. 18360

[ * ] Notice: The portion of the term of this patent subsequent to Feb. 17, 1993, has been disclaimed.

[21] Appl. No.: 734,353

[22] Filed: Oct. 20, 1976

[51] Int. Cl.[2] ..... A63B 31/02

[52] U.S. Cl. ..... 9/308

[58] Field of Search ..... 9/301–303, 9/307, 308; 2/2.1 R, 2.1 A, 19, 158, 159, 163

[56] References Cited

U.S. PATENT DOCUMENTS

| | | | |
|---|---|---|---|
| 3,534,406 | 10/1970 | Barthlome | 2/2.1 A |
| 3,938,207 | 2/1976 | Drescher | 9/308 |

FOREIGN PATENT DOCUMENTS

| | | | |
|---|---|---|---|
| 796,667 | 4/1936 | France | 2/163 |

*Primary Examiner*—Trygve M. Blix
*Assistant Examiner*—Jesus D. Sotelo
*Attorney, Agent, or Firm*—Wenderoth, Lind & Ponack

[57] ABSTRACT

An improved swimmer's glove having a hand portion with a palm portion of flexible, non-stretchable material and a back portion, a plurality of partially hollow generally tubular fingers extending from the hand portion in a normal position, joints joining the fingers to the hand portion, and flexible webs between adjacent fingers. Each joint has an upper portion projecting at least to the back side of the glove and the joint is bendable only in the closing direction of the hand for reinforcing the hand and fingers of the swimmer against bending in the opening direction of the hand when force is exerted on the glove from the side toward the closing direction of the hand as the swimmer moves the glove through the water while swimming. The joints have a lower joint portion structure of a flexible, non-stretchable material which is connected with the portions of the glove on either side thereof for forming a flexible, non-stretchable hinge and for positioning the lower portion of each joint closer to the lower portions of adjacent joints with the glove in the closed position, whereby the glove can be bent easily around the lower portion of the joints when the hand of the swimmer is closed.

15 Claims, 13 Drawing Figures

SWIMMER'S GLOVE

This invention relates to an improved swimmer's glove, and more particularly relates to an improved swimmer's glove in which the lower portions of the joints in the fingers of the glove, between the fingers of the glove and the hand portion of the glove, and between the hand portion and the wrist portion of the glove, are constructed so that when the swimmer has closed his hand and fingers, the distances between the joints along these portions have become less than the distances between corresponding joints on the back of the glove.

BACKGROUND OF THE INVENTION AND PRIOR ART

In my prior U.S. Pat. No. 3,938,207, there is disclosed a swimmer's glove in which the joints joining the portions of the fingers, joining the fingers to the hand portion of the glove, and joining the hand portion of the glove to the wrist portion, are constructed so that they permit bending of the joints in the closing direction of the hand, but substantially prevent bending in the opposite direction, thereby reinforcing the hand and fingers of the swimmer against bending in the opening direction when force is exerted on the glove from the side toward the closing direction of the hand, i.e. the palm of the hand of the wearer, as the swimmer moves the glove through the water while swimming.

It has now been found that the glove as disclosed in that patent can be greatly improved by changing the structure of the lower portion of the various joints to allow for the fact that when a swimmer has closed his hand and fingers, the distances between the portions of the joints along the palm side of the hand and fingers has become less, because of the bulk of the bones and the fleshy part of the hand and fingers, than the distances between the joints along the back portion of the hand and fingers, which remain the same.

It has been determined that when the swimming glove of the present invention is completely closed, i.e. curled in the direction of the closing of the palm of the hand of the swimmer wearing the glove, the distance between the joints of the fingers and the joint between the fingers and the hand portion along the palm portion of the glove will be approximately one-half the corresponding distance between the joints along the back portion of the glove.

OBJECTS AND BRIEF DESCRIPTION OF THE INVENTION

It is therefore an object of the present invention to provide an improved swimming glove of the type shown in U.S. Pat. No. 3,938,207, in which the structure of the joints will permit the lower portions of the joints along the palm side of the glove to be closer to each other than the corresponding portions on the back of the glove when the glove is closed.

It is a further object of the present invention to provide an improved swimming glove of the type shown in U.S. Pat. No. 3,938,207, in which the structure of the joints along the palm portion of the glove permit the joints along the palm portion to be moved toward each other so that when the glove is fully closed, the joints are spaced apart only approximately one-half the distance of the spacing of the corresponding joints along the back portion of the glove.

It is a further object of the present invention to provide an improved swimming glove of the type shown in U.S. Pat. No. 3,938,207 in which the structure of the joints along the palm portion of the glove predisposes the lower portions of certain of the joints so that they are closer to the lower portions of adjacent joints than corresponding joints along the back portion of the gloves when the glove is closed.

It is a still further object of the present invention to provide an improved swimming glove of the type shown in U.S. Pat. No. 3,938,207 in which the structure of the lower portion of the joints between the portions of the fingers and between the fingers and the hand of the glove are constructed so that they are held substantially in position below the upper portions of the joints along the back of the glove.

These objects are achieved by a swimmer's glove according to the present invention having a hand portion with a palm portion of flexible, non-stretchable material and a back portion, a plurality of partially hollow generally tubular fingers extending from said hand portion in a normal position, joints joining said fingers to said hand portion, at least one joint along each of said fingers outwardly of said hand portion, at least one joint enlargement along each of said fingers outwardly of said hand portion, at least one joint enlargement along each of said fingers at said joint along said finger, and flexible webs between adjacent fingers, each joint having an upper portion projecting at least to the back side of the glove and including means for permitting bending of the joint in the closing direction of the hand and for reinforcing the hand and fingers of the swimmer against bending in the opening direction of the hand when force is exerted on the glove from the side toward the closing direction of the hand as the swimmer moves the glove through the water while swimming. The glove has an improved lower joint portion means of a flexible, non-stretchable material and constituting part of at least one joint on the palm side of the glove and which is connected with the portions of the glove of either side thereof for forming a flexible, non-stretchable hinge and for positioning the lower portion of each joint closer to the lower portions of adjacent joints with the glove in the closed position, whereby the glove can be bent easily around the lower portion of the joints when the hand of the swimmer is closed.

BRIEF DESCRIPTION OF THE FIGURES

The invention will now be described with reference to the accompanying drawings, in which:

FIG. 3c is a section taken along line 3c—3c of FIG. 3a;

Figure 1:
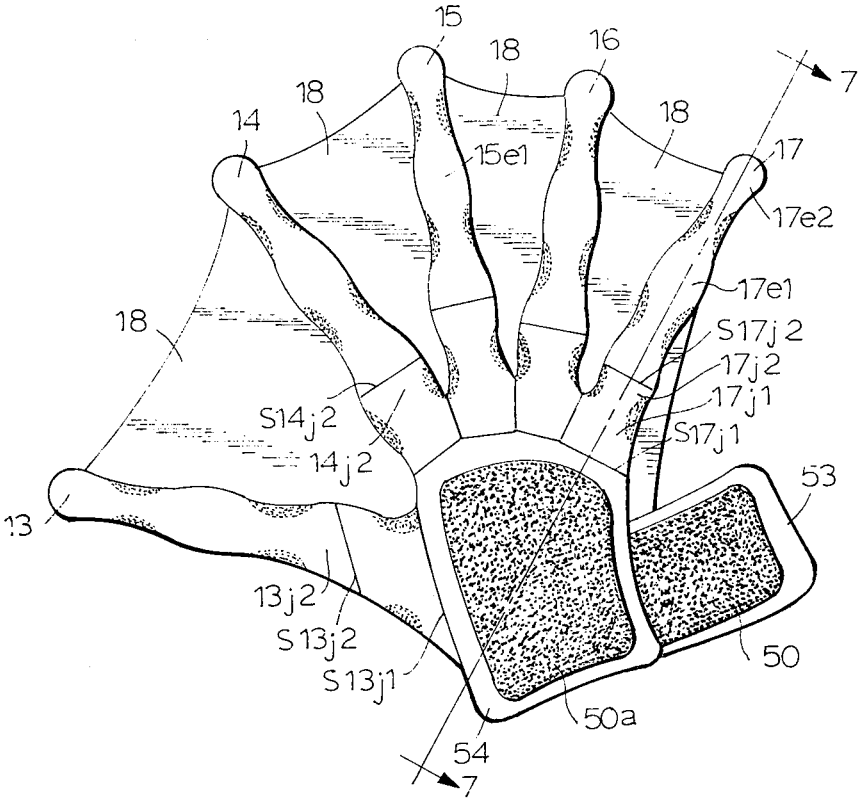
FIG. 1 is a plan view of the back of a swimmer's glove according to the invention.

In the following description, when reference is made to "fingers", this will generally be understood to include the thumb, unless it is specified otherwise. Also, the references to "upper" and "lower" are with respect to the glove in the position in the drawings, and correspond to the back of the glove and the palm of the glove, respectively.

DETAILED DESCRIPTION OF THE FIGURES

Referring first to FIGS. 1–3c, there is shown a swimmer's glove of the type disclosed in U.S. Pat. No. 3,938,207, having a hand portion made up of a palm portion 11 and a back portion 12 of resilient material, such as molded rubber or plastic, preferably integrally joined or connected along at least the side edges between the little finger and the wrist, between the thumb and the forefinger, and between the thumb and the wrist.

Extending from the hand portions are a plurality of fingers shown in FIG. 1 as the thumb 13, the index finger 14, middle finger 15, ring finger 16, and little finger 17. Each of these fingers is a partially hollow generally tubular element, i.e. it is hollow along the portion closest to the palm, and is a solid cylindrical element toward the tip thereof. It is also of resilient material, such as molded rubber or plastic, and is joined to the hand portion by a joint therealong, and outwardly of the joints at the hand portion is a plurality of joint enlargements. The joints are designated by the number for the finger plus a subscript *j* and a number, while the enlargements are designated by the number for the finger plus a subscript *e* and a number. Thus, the joint between the hand portion and the index finger 14 is designated $\mathbf{14}_{j1}$, while the joint at the second joint of the index finger is designated $\mathbf{14}_{j2}$, the first enlargement of the index finger is designated $\mathbf{14}_{e1}$, etc.

The upper portion of each joint has a slit therein, the slits being given the number of the joint with the prefix *s*. Thus, the slit in the upper part of joint $\mathbf{17}_{j1}$ is $s17_{j1}$. In the embodiment of FIGS. 1–6, the slits in the first joints of the fingers are preferably all straight. The slit in the second joint in the thumb 13 is at an angle $\alpha$ about 60° to the length of the thumb being angled with the end closer to the wrist being closer to the hand portion. The slits at the joints between the fingers and the hands are preferably perpendicular to the plane of the glove. Thus, the slit $s\mathbf{13}_{j1}$ in the joint $\mathbf{13}_{ji}$ between the thumb 13 and the hand portion is a slit extending from the point between the thumb and the index finger to a point between the thumb and wrist. There is a slit $s\mathbf{14}_{ji}$ in the joint $\mathbf{14}_{j1}$ between the hand portion and the index finger 14, and a slit $s\mathbf{16}_{j1}$ in the joint $\mathbf{16}_{j1}$ between the hand portion and the ring finger 16. There are slits in the joints $\mathbf{15}_{j1}$ and $\mathbf{17}_{j1}$ between the middle finger 15 and the little finger 17, and a slit $s\mathbf{13}_{j1}$ in the thumb joint.

In the improved swimmer's glove according to the present invention, there is provided a palm portion forming part of the lower portion of each joint, as shown in FIGS. 2a–3c, which palm portions will be given the number of the corresponding joint with the prefix *pp*. Thus, the palm portion of the first joint of the little finger 17 is designated $pp17_{j1}$, while the palm portion of the second joint of the little finger is designated $pp17_{j2}$. There is also a palm portion $pp14_j\mathbf{1}$ at the lower portion of the joint $\mathbf{14}_j\mathbf{1}$, between the hand portion and the index finger 14; and a palm portion $pp16_j\mathbf{1}$ at the lower portion of the joint $\mathbf{16}_j\mathbf{1}$ between the hand portion and the ring finger 16. There are palm portions at the lower portions of the joints $\mathbf{15}_j\mathbf{1}$, $\mathbf{17}_j\mathbf{1}$, and below the thumb joint $\mathbf{13}_j\mathbf{1}$. With respect to the material of the fingers of the glove, at least the palm portions are of a thin flexible, nonstretchable material, e.g. a molded rubber or plastic material with inextensible reinforcement members such as wires or cord embedded therein. The remainder of the fingers and the hand portion are relatively thick.

Between each two adjacent fingers is a web 18 of flexible material, such as rubber or plastic, which is preferably connected or integrally formed with the fingers and a web portion 19 formed between the outside edge of the finger 17 and the hand portion.

In FIG. 1, one type of fastening means is shown having a piece of easily releasable material such as the material sold under the trademark "Velcro", comprising a Velcro material 50 on one wrist flap 53 which is engagable with another piece of complementary material 50a on the other wrist flap 54, or vice-versa, to secure the wrist portion of the glove around the wrist of the wearer. However, it is understood that any conventional type of wrist fastening means may be used.

Figure 2A:
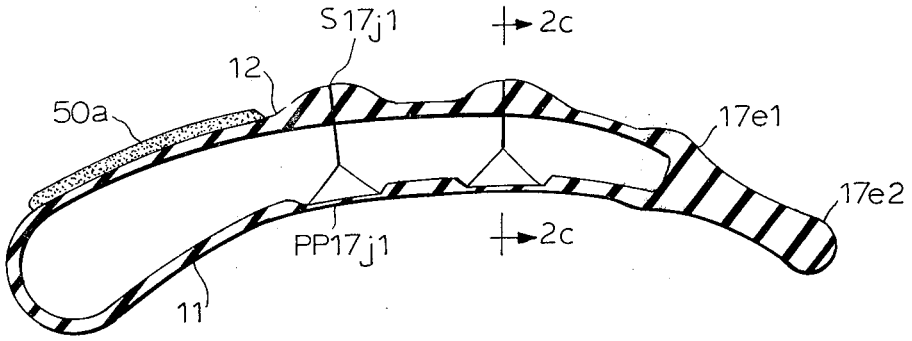
FIG. 2*a* is a section taken along line 2—2 of FIG. 1 with the glove in the cupped or swimming position, showing a first embodiment of "pleated" palm portions.
Figure 2B:
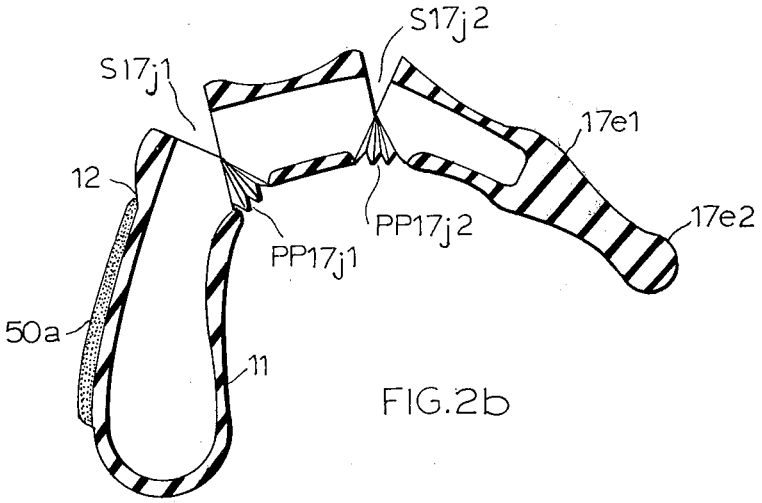
FIG. 2*b* is a section taken along line 2—2 of FIG. 1 with the glove closed more than in the cupped or swimming position having a pleated palm portion.
Figure 3A:
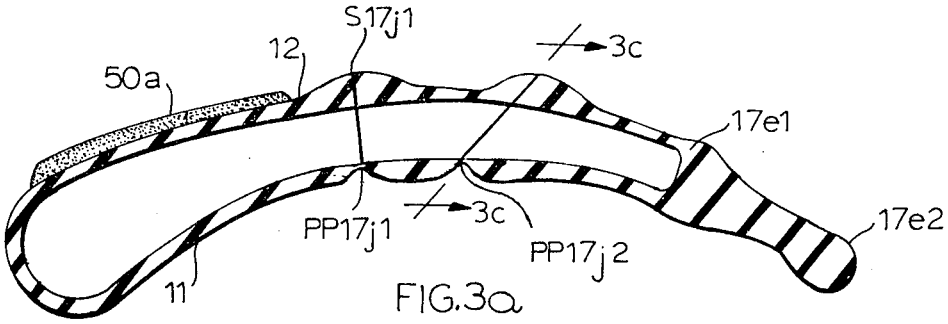
FIG. 3*a* is a section taken along line 2—2 of FIG. 1 with the glove in the cupped or swimming position, showing a second embodiment of "receded" palm portions.
Figure 3B:
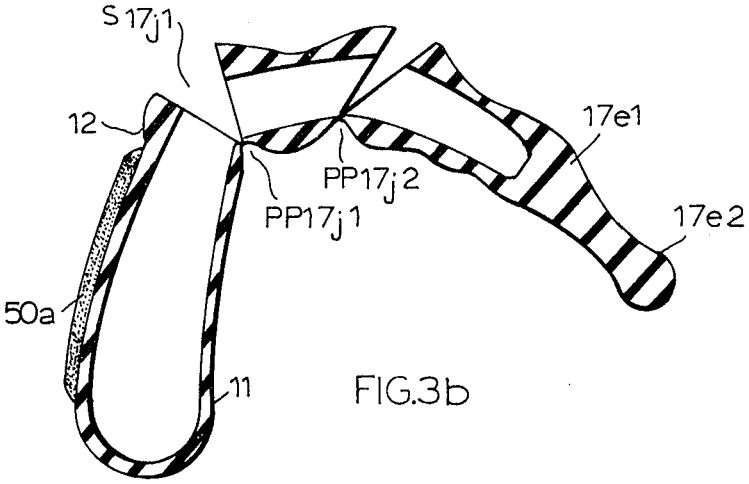
FIG. 3*b* is a section taken along line 2—2 of FIG. 1 with the glove closed more than in the cupped or swimming position, having receded palm portions.

It will be seen that with the joints in the position in which the slits are closed, as in FIGS. 2a and 3a, the joints become rigid with respect to forces from the direction of the palm portion, and the fingers cannot be bent back in the direction opposing their normal cupped swimming position. On the other hand, as seen in FIGS. 2b and 3b, lower portions of the joints can be bent when the fingers are bent toward the closed position of the hand, while the slits in the upper parts of the joints will open, thus allowing the wearer of the glove to close his hand in order to grasp objects or perform other operations. In other words, the joints are movable from a normal cupped position of the hand only in the direction of closing of the hand. When the glove is on the hand of a swimmer, heretofore the force exerted against the hand is resisted by the natural strength of the hand which is greatly reinforced by the structure of the glove, including the joints and the cross-sectional shape of the fingers together with the reinforcing in the hand portion of the glove, so that the swimmer can exert great force on the water. Since the position of the fingers when the joints become rigid against such forces is the desired cupped position, the swimmer's hand is kept in the most efficient swimming position during movement through the water. On the other hand, when the swimmer desires to close his hand for any reason, such as to grasp an object, the joints of the glove and the flexible nonstretchable lower portion bend easily.

Figure 2C:
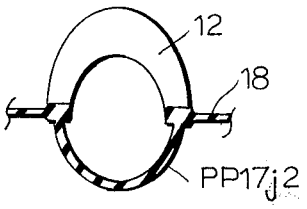
FIG. 2*c* is a section taken along line 2*c*—2*c* of FIG. 2*a;*

FIGS. 2a–2c show a first embodiment of the palm portions which will be called "pleated" palm portions. As can be seen from FIG. 2a, the nonstretchable but flexible palm portions $pp17_j1$ and $pp17_j2$ are dimensioned so as to be taut when the glove is in the cupped or swimming position. As can be seen from FIG. 2b, the palm portions $pp17_j1$ and $pp17_j2$ become folded or pleated when the glove is closed more than in the cupped or swimming position. The palm portions extend substantially equidistantly in opposite directions along the fingers and hand portion from the joints, with the lower portions of the fingers between the palm portions being about half the length of the upper portions of the fingers between the joints.

The pleated palm portions are thus "contained" to function directly below the joints in the upper portion. This is the preferred position. By providing the pleated palm portions below the hinged sections of each joint, when the glove is closed, the distance between the centers of palm portions $pp17_j1$ and $pp17_j2$ become less and less until eventually, when the glove is fully closed, it becomes about one-half the distance between joints $17_j1$ and $17_j2$ in the upper portion of the glove.

FIG. 2c shows the joint $17_j2$ with a pleated lower portion $pp17_j2$ preferably hinged about an axis at the middle portion of each finger. The joint is hinged in two places, at both sides of each finger when the web 18 and the finger join. The pleated palm portion is joined to the remainder of the finger below the hinged portion of each joint.

FIGS. 2a, 2b and 2c have been shown with straight slits $s17_j1$ and $s17_j2$ perpendicular to the plane of the glove. However, other designs of slits may be used.

Figure 3C:
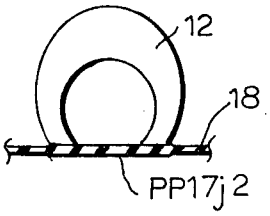

FIGS. 3a, 3b and 3c show a second embodiment of palm portions which will be called "recessed" palm portions. These palm portions are flat portions which are thinner than the material of the fingers in the remainder of the length of the fingers, and slits $s17_j1$ and $s17_j2$ extend through the joints to the level of the flat portions. As can be seen in FIG. 3a, when the glove is in the cupped or swimming position, palm portions $pp17_j1$ and $pp17_j2$ are prepositioned so as to already be spaced about one-half the distance between the joints $17_j1$ and $17_j2$ in the upper portion. As can be seen in FIG. 3b, when the glove is closed more than in the cupped or swimming position, the distance between palm portions $pp17_j1$ and $pp17_j2$ is still the same as shown in FIG. 3a.

The recessed palm portions are thus "contained" so that palm portion $pp17_j1$ is directly below its corresponding joint $17_j1$ in the upper portion, and palm portion $pp17_j2$ is directly below the half-way point between joints $17_j1$ and $17_j2$ in the upper portion of the fingers. The slits $17_j2$ of the second joint of each finger are angled from the middle of the second joint of each finger to the corresponding palm portion directly below the half-way point between the first joints and the second joints in the upper portion of each finger.

FIG. 3c shows clearly that a joint with a recessed palm portion is hinged at the extreme lower portion of each finger. Also, such a joint is hinged in one place only, i.e. directly beneath the swimmer's inserted finger. In reality, the recessed palm portion is also acting as the hinged portion for each joint.

FIGS. 3a, 3b and 3c show a straight slit $s17_j2$ . . . which is slanted from the recessed palm portion $pp17_j2$ in the lower portion of the finger to the middle of the second joint $17_j2$ in the upper portion.

Figure 4:
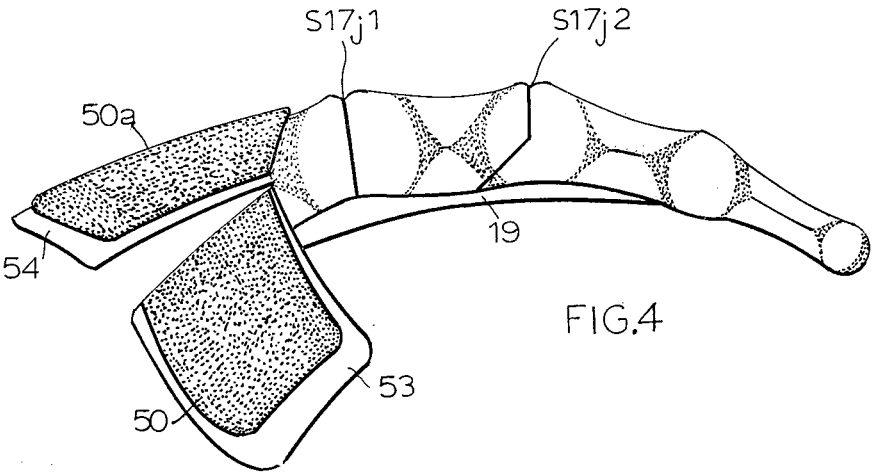
FIG. 4 is a side elevation of the glove of FIG. 1 as viewed from the right side of FIG. 1 having a modified form of slit similar to the type slits of FIGS. 3a–3c.

FIG. 4 shows another type of slit which may be incorporated between the second joint and its corresponding recessed palm portion. The slit extends upwardly at an angle toward the back side of the glove and then perpendicularly to the length of the glove, when observed from the side of the finger, and contains one angle on each side of the joint.

Figure 5:
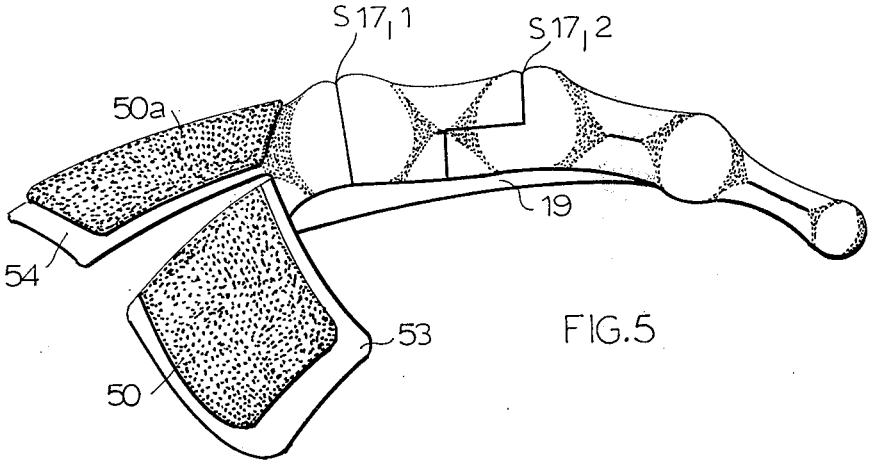
FIG. 5 is a side elevation of the glove of FIG. 1 as viewed from the right side of FIG. 1 having another modified form of slits similar to the type of slits of FIGS. 3a–3c.

FIG. 5 shows another type of slit which extends upwardly to about the midpoint between the palm and the back sides of the glove, then substantially along the length of the glove, and then upwardly again, and which contains two angles on each side of the second joint.

Figure 6:
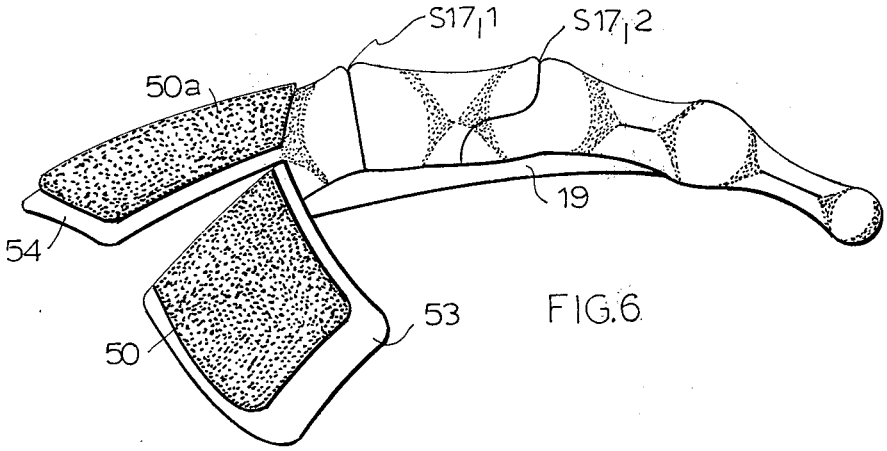
FIG. 6 is a side elevation of the glove as viewed from the right side having another modified form of slit similar to the type slits of FIGS. 3a–3c.

FIG. 6 shows another type of slit which is a generally S-shaped curve, when observed from the side, and which contains two oppositely extending curves on each side of the second joint.

It should be understood that any combination of the above-mentioned slits may also be used.

Figure 7:
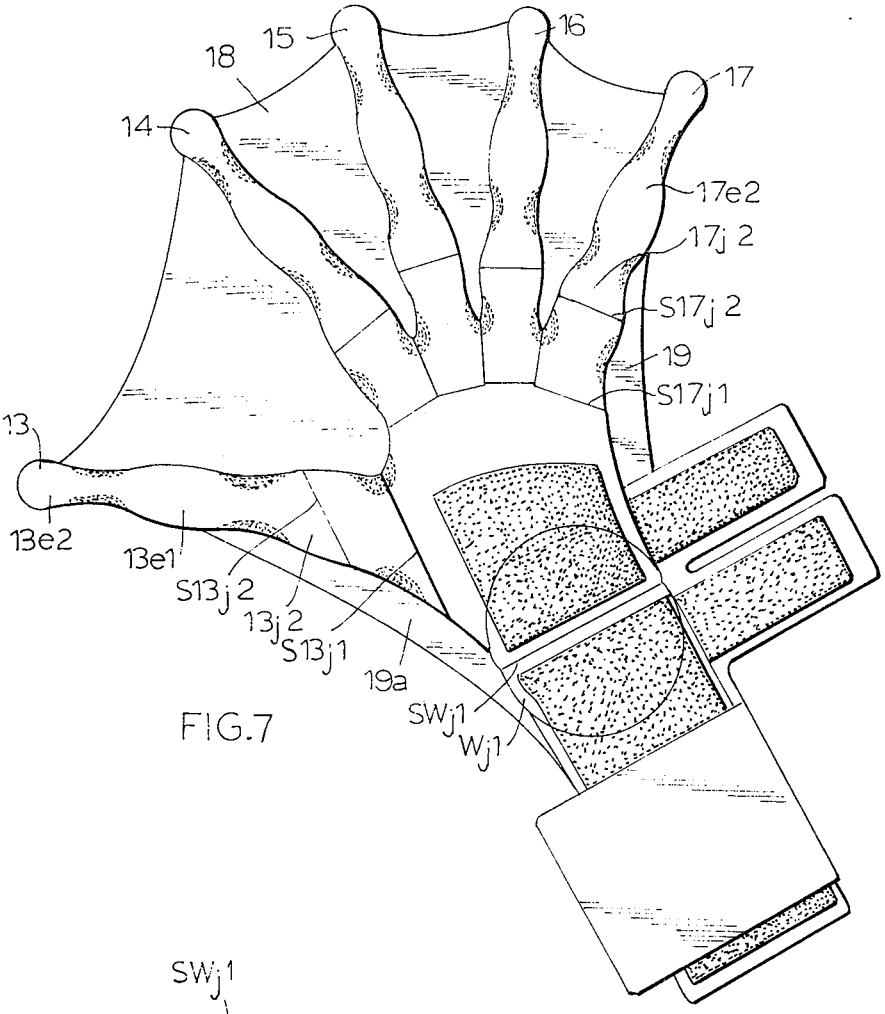
FIG. 7 is a plan view of a modified swimmer's glove as shown in FIG. 1.
Figure 7A:
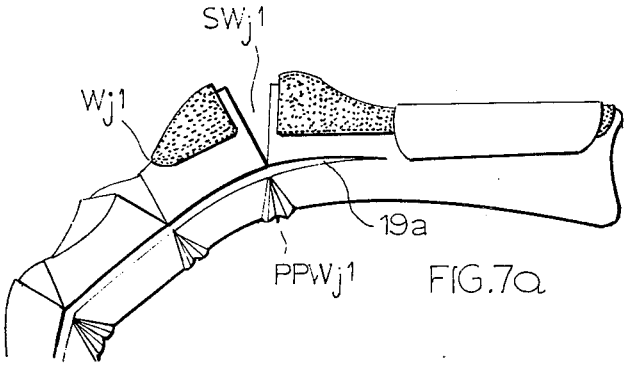
FIG. 7a is a side elevation of the glove of FIG. 7 as viewed from the left side of FIG. 7 having pleated palm portions.
Figure 7B:
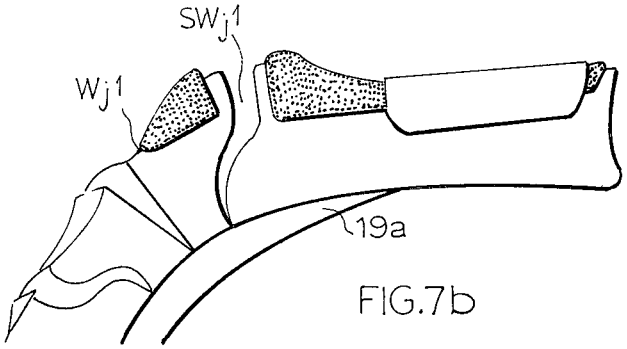
FIG. 7b is a side elevation of the glove of FIG. 7 as viewed from the left side of FIG. 7 having recessed palm portions.

A joint such as is provided at the knuckles of the finger portions of the glove can also be provided at the wrist portion of the glove to provide reinforcement of the wrist of the swimmer against the pressure of the water as the hand, wrist, and arm move through the water. Such a joint is shown in FIGS. 7, 7a and 7b. There is provided a slit $sw_{j1}$ on the wrist joint enlargement $w_{j1}$.

Likewise, a palm portion $pp\mathrm{w}_j1$, such as is provided below the joints of the finger portions of the glove, can also be provided below the joint $w_j1$ at the wrist portion of the glove.

In FIG. 7, a web portion 19 is provided on finger 17, which extends to the wrist portion. There is also a web portion 19a on the thumb 13 which also extends to the wrist portion.

FIG. 7a shows a palm portion $pp\mathrm{W}_j1$ which is the "pleated" type, as described above in connection with FIGS. 2a–2c.

FIG. 7b shows a palm portion $pp\mathrm{W}_j1$ which is of the recessed type, as described above in connection with FIGS. 3a–3c.

As a swimmer wearing the glove as described above closes his hand and fingers and wrist the distance between the first joint of each finger and the wrist joint along the palm of his hand becomes less and less, in comparison with the distance between the first joints of each finger and the wrist joint along the back of his hand. Likewise, the glove must work in synchronism with the swimmer's hand within the glove, and that distance between the first joint of each finger and the wrist joint along the lower portion of the glove must become less and less as the glove closes.

In each of the gloves illustrated, the rigid upper portions may be made of the same or different material and may be made integral with one another or joined by any conventional means. It is understood that if the upper and lower portions are of the same material, the upper portion can be made rigid by increasing the thickness.

The lower or palm portion may be of any suitable flexible, non-stretchable material which can be joined with the upper portion. The lower portion can be either of rubber, plastic, canvas material, or the like.

Also, the type and angle of the slits may be varied, and any combination may be used, depending upon the specific requirements of the wearer and of the type and thickness of materials used in the manufacture of the glove. The web portions of the glove of this invention may be of the same or different material than the other glove members. The web portion is preferably either attached to the fingers halfway between the upper and lower portions of the glove, or on the lower portion only. The degree of flexibility of the web portions is based on the requirements of the wearer and may vary by the degree of thickness of the web at different areas.

While molded rubber or plastic has been mentioned as a material of which the glove according to the invention can be made, and while this is the preferred material, other materials such as fabric reinforced rubber, plastic, fabric reinforced plastic, and the like can also be used. It will be appreciated that while only a right-hand glove has been shown, if a pair is desired, a left-hand glove can be made in a mirror image to the glove as shown and described.

It will therefore be seen that there has been provided an improved glove which in fact is an effort to adapt to a man-made structure the functional and structural principles which abound in nature.

Among the amphibians, numerous species of toads and frogs (Family Pipidae and Family Ranidae, respectively) employ webbed hind feet which are specialized for subsurface swimming. Among the world's more than 250 true frog species, *Conraua goliath* and the bullfrog *Rana grylio* have hind feet with extraordinarily large webs.

Among the numerous aquatic birds employing specialized webbed feet are loons, grebes, petrels, pelicans, tropicbirds, frigatebirds, gannets, boobies, cormorants, anhingas, swans, geese, tree ducks, bay ducks, sea ducks, stiff-tailed ducks, and penquins, just to name a few. Penguins, which are native to the Southern Hemisphere, and auks, which are native today in Greenland and Iceland, not only have webbed feet, but also have paddle-like wings which are specialized, not for flight, but for swimming.

Also among natures' offspring are the mammals, of which man is a member. The duck-billed platypus *Ornithorhynchus anatinus* (found only on the continent of Australia) and the river otter *Lutra canadensis* (found on every continent but Australia) are unique in that they are the only mammals naturally employing webs between the toes of both their hind feet and their fore-feet. These mammals are dependant upon these specialized feet for swimming.

The glove of the present invention closely approximates the structural and functional features of the webbed feet of these various creatures, and as such is an adaption of these principles and functions to mans' use.

It is thought that the invention and its advantages will be understood from the foregoing description, and it is apparent that various changes may be made in the form, construction and arrangement of the parts without departing from the spirit and scope of the invention or sacrificing its material advantages, the form hereinbefore described and illustrated in the drawings being merely a preferred embodiment thereof.

What is claimed is:

1. In a swimmer's glove having a hand portion with a palm portion of flexible, non-stretchable material and a back portion, a plurality of partially hollow generally tubular fingers extending from said hand portion in a normal position, joints joining said fingers to said hand portion, at least one joint along each of said fingers outwardly of said hand portion, at least one joint enlargement along each of the said fingers outwardly of said joint along said finger, and flexible webs between adjacent fingers, each joint having an upper portion projecting at least to the back side of the glove and including means for permitting bending of the joint in the closing direction of the hand and for reinforcing the hand and fingers of the swimmer against bending in the opening direction of the hand when force is exerted on the glove from the side toward the closing direction of the hand as the swimmer moves the glove through the water while swimming, the improvement comprising a lower joint portion means of a flexible, non-stretchable material and constituting part of at least one joint on the palm side of the glove and which is connected with the portions of the glove on either side thereof and having pleats therein extending transversely of the length of the glove for forming a flexible, non-stretchable hinge permitting positioning of the lower portion of each joint closer to the lower portions of adjacent joints when the glove is in the closed position, whereby the glove can be bent easily around the lower portion of the joints when the hand of the swimmer is closed.

2. The improvement as claimed in claim 1 in which said pleats extend around the lower portion of the joint between points substantially midway between the top and bottom of the joint, whereby the joint is hinged around an axis at said midpoint.

3. The improvement as claimed in claim 2 in which said material is pleated for substantially the same distance on opposite sides of the joint in the direction of the length of the glove, whereby the pleats are held substantially directly below the upper portion of the joint.

4. The improvement as claimed in claim 1 in which said lower joint portion means constitute part of each joint on the palm side of the glove.

5. In a swimmer's glove having a hand portion with a palm portion of flexible, non-stretchable material and a back portion, a plurality of partially hollow generally tubular fingers extending from said hand portion in a normal position, joints joining said fingers to said hand portion, at least one joint along each of said fingers outwardly of said hand portion, at least one joint enlargement along each of said fingers outwardly of said joint along said finger, and flexible webs between adjacent fingers, each joint having an upper portion projecting at least to the back side of the glove and including means for permitting bending of the joint in the closing direction of the hand and for reinforcing the hand and fingers of the swimmer against bending in the opening direction of the hand when force is exerted on the glove from the side toward the closing direction of the hand as the swimmer moves the glove through the water while swimming, the improvement comprising a lower joint portion means in the form of a hinge of a flexible, non-stretchable material and constituting part of at least one joint on the palm side of the glove and which is connected with the portions of the glove on either side thereof, said hinge being positioned outwardly, in the direction away from the hand portion of the glove, of the lower portion of the next adjacent joint, a distance less than the distance between the upper portions of the corresponding joints, and the joint having a slit therein extending from said hinge upwardly to the back of the glove to the position of the upper portion of the joint, said hinge positioning the lower portion of each joint closer to the lower portions of adjacent joints with the glove in the closed position, whereby the glove can be bent easily around the lower portion of the joints when the hand of the swimmer is closed.

6. The improvement as claimed in claim 5 in which said slit extending from said lower joint portion means is a straight slit at an angle to the length of the glove.

7. The improvement as claimed in claim 5 in which said slit extending from said lower joint portion extends at an angle to the length of the glove to about the midpoint between the palm and the back sides of the glove, and then substantially perpendicularly to the length of the glove.

8. The improvement as claimed in claim 5 in which said slit extending from said lower joint portion extends perpendicular to the length of the glove to a point about midway between the palm and the back sides of the glove, then substantially along the length of the glove, and then perpendicular to the length of the glove.

9. The improvement as claimed in claim 5 in which said slit extending form the lower joint portion extends in a generally S-shaped curve.

10. The improvement as claimed in claim 5 in which the next adjacent joint in the direction toward the hand portion of the glove has the lower joint portion constituted by a hinge of said flexible, non-stretchable material on the palm side of the glove and has a slit extending substantially perpendicularly to the length of the glove from the lower joint portion to the upper joint portion thereof.

11. The improvement as claimed in claim 5 in which the hinge is thinner than the remainder of the material on the palm side of the glove and is recessed with respect to the surface of the material on the palm side of the glove.

12. The improvement as claimed in claim 5, in which said lower joint portion means constitute part of each joint on the palm side of the glove.

13. In a swimmer's glove having a hand portion with a palm portion of flexible, non-stretchable material and a back portion, a plurality of partially hollow generally tubular fingers extending from said hand portion in a normal position, joints joining said fingers to said hand portion, at least one joint along each of said fingers outwardly of said hand portion, flexible webs between adjacent fingers, a wrist portion, and a joint between said hand portion and said wrist portion having an upper portion projecting at least to the back side of the glove and including means for permitting bending of the joint in the closing direction of the hand and wrist and for reinforcing the wrist of the swimmer against bending in the opening direction of the hand and wrist when force is exerted on the glove from the side toward the closing direction as the swimmer moves the glove through the water while swimming, the improvement comprising a lower joint portion means of a flexible, non-stretchable material and constituting part of the joint on the palm side of the glove and which is connected with the hand portion of the glove and wrist portion on either side thereof for forming a flexible, non-stretchable hinge and for positioning the hand portion of the glove and the wrist portion closer to each other with the glove and the wrist portion in the closed position, whereby the glove can be bent easily around the lower portion of the joint when the hand of the swimmer is bent around the wrist.

14. The improvement as claimed in claim 13 in which said lower joint portion means comprises pleats in said flexible, non-stretchable material and extending transversely of the length of the glove and wrist portion.

15. In a swimmer's glove having a hand portion with a palm portion of flexible, non-stretchable material and a back portion, a plurality of partially hollow generally tubular fingers extending from said hand portion in a normal position, joints joining said fingers to said hand portion, at least one joint along each of said fingers outwardly of said hand portion, flexible webs between adjacent fingers, a wrist portion, and a joint between said hand portion and said wrist portion having an upper portion projecting at least to the back side of the glove and including means for permitting bending of the joint in the closing direction of the hand and wrist and for reinforcing the wrist of the swimmer against bending in the opening direction of the hand and wrist when force is exerted on the glove from the side toward the closing direction as the swimmer moves the glove through the water while swimming, the improvement comprising a lower joint hinge of a flexible, non-stretchable material on the palm side of the glove and which is connected with the hand portion of the glove and the wrist portion on either side of the joint for forming a flexible, non-stretchable hinge, the lower joint hinge being closer to the hand portion, and the joint having a slit therein extending from said hinge upwardly to the back of the wrist portion, whereby the glove can be bent easily around the lower joint hinge when the hand of the swimmer is bent around the wrist.

* * * * *